United States Patent [19]

Hoinkis

[11] Patent Number: 4,601,234

[45] Date of Patent: Jul. 22, 1986

[54] PRESSURE CYLINDER

[75] Inventor: Rainer E. Hoinkis, Filderstadt, Fed. Rep. of Germany

[73] Assignee: ORIGA GmbH Pneumatik, Fed. Rep. of Germany

[21] Appl. No.: 669,073

[22] Filed: Nov. 7, 1984

[30] Foreign Application Priority Data

Nov. 8, 1983 [DE] Fed. Rep. of Germany ..... 3340291

[51] Int. Cl.[4] ..... F01B 29/00

[52] U.S. Cl. ..... 92/88; 92/165 PR; 92/169; 92/146

[58] Field of Search ..... 92/88, 165 PR, 160, 92/146; 244/63

[56] References Cited

U.S. PATENT DOCUMENTS

| | | | |
|---|---|---|---|
| 2,200,427 | 5/1940 | Merz | 92/88 |
| 2,473,430 | 6/1949 | Hoffar | 92/166 |
| 2,698,603 | 1/1955 | Macewka | 92/146 |
| 4,300,439 | 11/1981 | Degnan | 92/146 |
| 4,481,869 | 11/1984 | Garlapaty | 92/88 |

FOREIGN PATENT DOCUMENTS

| | | | |
|---|---|---|---|
| 68088 | 1/1983 | European Pat. Off. | 92/88 |
| 83708 | 8/1971 | Fed. Rep. of Germany . | |
| 97272 | 4/1973 | Fed. Rep. of Germany . | |
| 2503069 | 7/1976 | Fed. Rep. of Germany . | |
| 2632748 | 2/1977 | Fed. Rep. of Germany . | |
| 2832190 | 2/1980 | Fed. Rep. of Germany . | |
| 3124915 | 1/1983 | Fed. Rep. of Germany . | |
| 6936881 | 7/1971 | France . | |
| WO83/02306 | 7/1983 | PCT Int'l Appl. | 92/88 |
| 470088 | 8/1937 | United Kingdom | 92/88 |
| 728038 | 4/1955 | United Kingdom | 92/88 |

*Primary Examiner*—Robert E. Garrett
*Assistant Examiner*—Mark A. Williamson
*Attorney, Agent, or Firm*—Steele, Gould & Fried

[57] ABSTRACT

A pressure cylinder with a piston arranged in an inner chamber of a tubular casing has a second, also cylindrical inner chamber parallel to the first inner chamber and in which is slidingly guided an auxiliary piston. An extension of the auxiliary piston and an extension of the first piston in each case pass through the elongated slot in the casing wall, the two extensions of the two pistons being rigidly interconnected, preferably with the aid of a joint plate.

7 Claims, 7 Drawing Figures

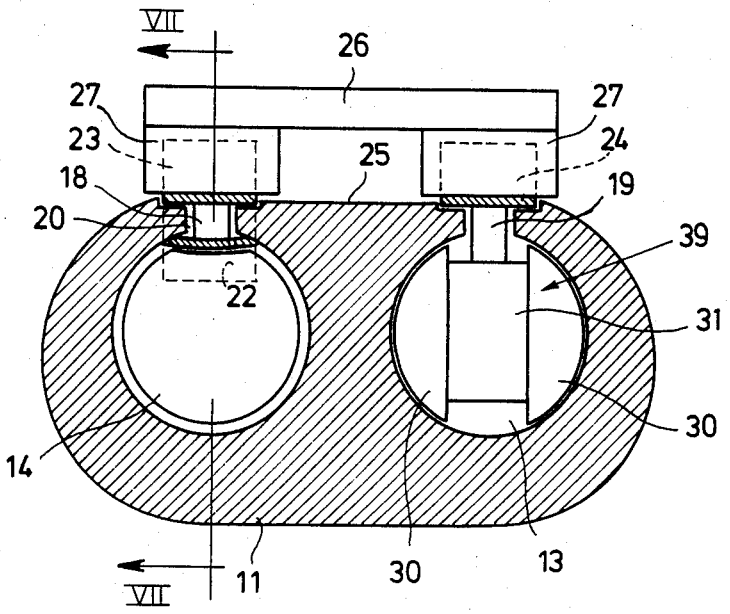
FIG. 3
FIG. 2
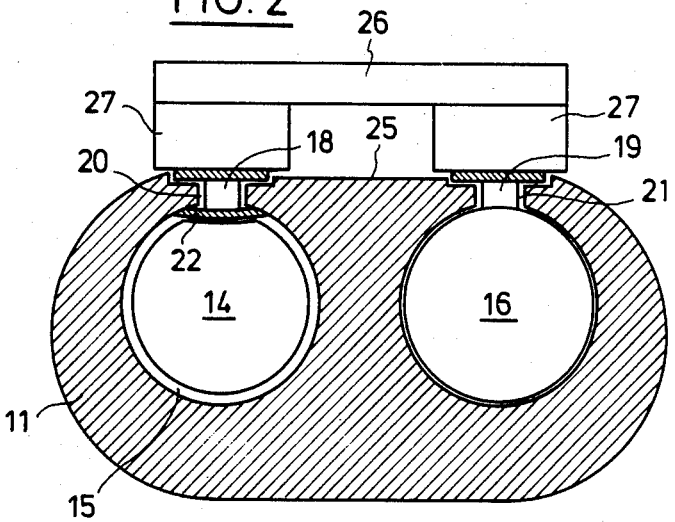

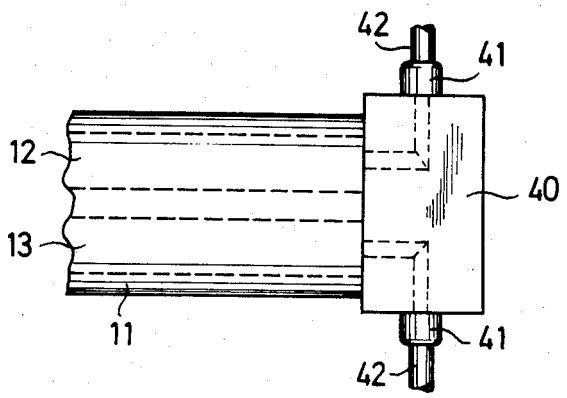
FIG. 5
FIG. 6
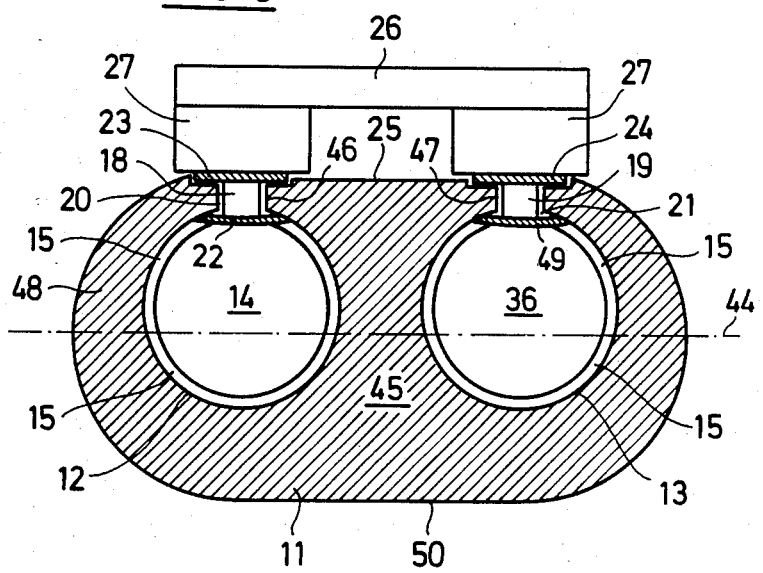

PRESSURE CYLINDER

BACKGROUND OF THE INVENTION

The invention relates to a pressure cylinder with a tubular casing, in which are arranged a plurality of parallel, cylindrical, inner chambers with in each case a longitudinally directed slot and a piston longitudinally guided in each inner chamber. Each piston has a force removal extension projecting outwards through the associated slot, connected via a connecting device with the other force removal extensions, at least one inner chamber being frontally terminated and provided with inlets and outlets. The piston guided in said inner chamber a packing at either end and the elongated slot of said inner chamber is sealed from the inside by a sealing strip.

British Pat. No. 470,088 discloses such a pressure cylinder arrangement, in which a plurality of cylinders are juxtaposed and are reinforced by external reinforcing webs. This arrangement aims at preventing widening of the elongated slots. In the described construction, there are three such cylinders, whose force removal extensions between them form in each case an angle of 120°. The force removal extension are connected to a saddle, which has an approximately V-shaped cross-section. A slide with wheels running in guide rails is used for guiding the force removal extensions and the saddle connected thereto.

In the case of rodless pressure cylinders with a single piston, it is known (German Offenlegungsschrift No. 3,124,915) to arrange two parallel guideways on either side of the elongated slot on the outside of the cylindrical tube and to provide the force transmission member with a bracket, which is supported against the guideways. However, this construction suffers from the disadvantage that the guideways are always open and can easily become dirty and that also during the movement of the piston in a widened area, considerable frictional forces occur, which must be overcome by applying additional pressure.

A similar arrangement is known from U.S. Pat. No. 2,473,430, where the force removal extension is provided with a bracket, which engages in a roughly U-shaped manner over the exterior of the casing and is slidingly fixed by its two ends to in each case one rod guided parallel to the cylindrical casing. The same disadvantages occur as with the arrangement according to Offenlegungsschrift No. 3,124,915.

In the case of pressure cylinders with a piston rod, it is known to arrange parallel pistons. However, in this case, the arrangement of several parallel cylinders cannot then contribute to ensuring a guidance of the outer end of the piston rod.

SUMMARY OF THE INVENTION

The problem of the invention is to construct a pressure cylinder of the aforementioned type that an exact lateral guidance of the force removal extension and the piston are ensured.

According to the invention, this problem is solved in that two inner chambers and two pistons are arranged in juxtaposed manner in common casing and are separated from one another by a central partition and the force removal extensions of the two pistons run parallel to one another and are screwed to a joint plate, the at least one sealed elongated slot being additionally sealed by an external sealing strip, which extends through the force removal extension.

This arrangement ensures that the pistons and their force removal extensions are exactly guided on the non-deformable, central partition. Thus, it is still not possible for there to be a lateral movement of the force removal extensions even if the elongated slots are slightly widened due to the action of pressure. Any widening of the elongated slots only acts on the side thereof which is remote from the partition. Due to the parallelism of the force removal extensions, a precise guide clearance for fitting the cylinder unit is provided.

The arrangement of the per se known additional, outer sealing strip makes it possible for there to be no pressure loss, even on widening the elongated slot, so that any widening of said slot which may occur has no influence on the operation of the pressure cylinder proposed by the invention.

The arrangement in common casing leads to optimum casing rigidity, so that the possibility of the casing bending is also reduced. The two inner chambers need not have the same cross-section and can, for example, have a different cross-sectional surface or a different shape. However, it is particularly appropriate for the inner chambers to have the same shape and cross-section.

While one piston has a packing at either end, so that it can be moved by the pressure medium, it is possible for the second piston to have no packing and to act as a guide piston. It can therefore be sufficient for it to only partially fill the cross-section, it being obvious that in this case it must still engage with at least part of the inner wall. The measures proposed by the invention not only lead to an exact guidance of the piston, but also ensures that the complete guidance means is located within the casing and is only accessible through the elongated slot, so that the risk of pollution or contamination is also eliminated in this construction. This more particularly applies if, as is further proposed by the invention, the inner chamber for the guide piston is also closed at both end faces.

According to a further development of the invention, both pistons can have packings for a pressure medium. This makes it possible to also exert pressure on the inner chamber of the cylinder in which the second piston is arranged, so that the same pressue prevails in both parallel inner chambers. Thus, the central partition, is freed from any one-sided, lateral force action, so that no deformation or lateral movement can occur on this partition. This leads to completely pressure-independent guidance characteristics of the pressure cylinder according to the invention. This also ensures that no one-sided thrust moment can act and also that an accurately set guide clearance for fitting the cylinder unit is provided. Thus, the pressure cylinder according to the invention is much more advantageous than the known pressure cylinders, in which the guides are laterally supported on the outer or inner walls of the pressure cylinder. Particular preference is given to this construction in uses, where particularly precise guidance is important.

The two inner chambers can be constructed for the action of the same pressure medium. For example, this could be achieved in that the components frontally terminating the inner chambers have a single connection for the pressure medium, which is connected with both inner chambers.

However, it is particularly advantageous if both inner chambers have separate feed lines, so that either the same pressure medium under different conditions, or different media can act in the two inner chambers. In this case, both pressure chambers can be designed independently of one another and the characteristics of different pressure media can be utilized. For example, one piston can be operated by air pressure and the other by oil pressure.

According to a further development, both pistons have approximately the same length and the joint plate extends roughly over the entire length of both pistons. As the two pistons are juxtaposed, this ensures that the total length of the two pistons is utilized for ensuring guidance, so that for geometrical reasons alone, guidance is particularly good, without it being necessary for the pressure cylinder arrangement to have a greater overall length.

In order to seal the guidance system even more effectively against contamination, according to the invention the elongated slot of the inner chamber for the guide piston can be sealed from the outside by a sealing strip, which is passed through the outer part of the auxiliary piston extension. This sealing strip ensures a perfect sealing of the elongated slot outside the area in which the actual extension is located. In the vicinity of the elongated slot, the casing can be provided with a device cooperating with the sealing strip for the positive fixing thereof. This can relate to the cooperation of magnetic strips on either side of the elongated slot or individual permanent magnets inserted in the vicinity of the elongated slot and which attract the optionally steel sealing strip. It is naturally also possible to provide lip-like projections on the outside of the casing and behind which can be pressed the e.g. elastic plastic outer sealing strip. The pressing in behind these lips can be carried out by means of a slide or sip fastener-like device fitted to the extension.

Advantageously, both pistons have an identical construction and optionally the elongated slots of both pistons are in each case sealed from the outside and the inside by a sealing strip. The outer sealing strips are passed through the outer parts of the force removal extensions and the inner sealing strips through the pistons.

BRIEF DESCRIPTION OF THE DRAWINGS

The invention is described in greater detail hereinafter relative to non-limitative embodiments and the attached drawings, wherein:

FIG. 2 is a section roughly along line II—II of FIG. 1.

FIG. 3 is a section corresponding to FIG. 2 through a modified embodiment with an only partly represented auxiliary piston.

FIG. 5 is one end of the cylinder in diagrammatic form.

FIG. 6 is a section through the embodiment of FIG. 4 roughly along line VI—VI thereof.

DETAILED DESCRIPTION OF THE PREFERRED EMBODIMENTS

Figure 1:
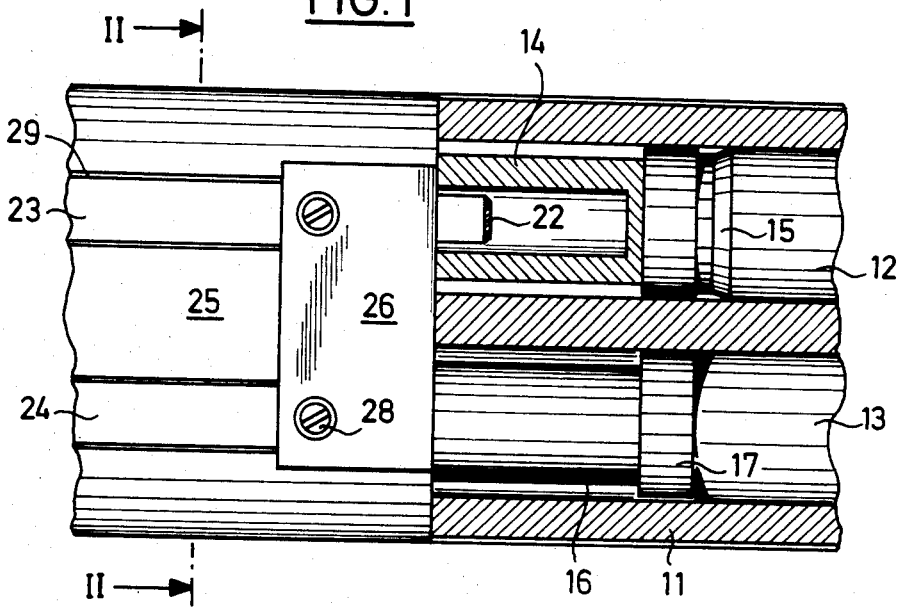
FIG. 1 is a broken-away longitudinal view of a pressure cylinder arrangement, partly sectioned.

FIG. 1 shows a view of a pressure cylinder arrangement. Casing 11 contains two longitudinally directed, cylindrical inner chambers 12, 13. In the represented embodiment, the inner chambers have a circular cross-section, but other shapes can also be used. A piston 14 having a packing 15 at either end is placed in inner chamber 12. At its two ends not shown in FIG. 1, casing 11 is closed and provided with an inlet and/or outlet, through which a pressure medium, e.g., compressed air, can be introduced into the inner chamber 12 on in each case one side of piston 14. By introducing pressure into inner chamber 12 on one side of piston 14, it is displaced in the opposite direction and as a result of this displacement of piston 14, a device connected thereto can be moved.

Parallel to the inner chamber 12 for piston 14 is provided the second inner chamber 13, which has the same diameter and cross-sectional shape. Inner chamber 13 contains an auxiliary piston 16, which is widened at both ends and in this widened area 17 can be provided e.g. with an adhesion-reducing coating. Auxiliary piston 16 has roughly the same length as piston 14.

As can be gathered from FIG. 2, both piston 14 and auxiliary piston 16 is in each case provided with an extension 18, 19, both of which project to the outside through in each case one elongated slot 20, 21 in casing 11. As is also shown in FIG. 1, both the side of elongated slot 20 facing inner chamber 12 and the side of elongated slot 20 facing the outside of casing 11 is in each case sealed by a sealing strip 22, 23. With respect to the upper piston 14, these sealing strips ensure a pressure-tight sealing of inner chamber 12. The outside of elongated slot 21 for auxiliary piston 16 is also sealed by a sealing strip 24, which is intended to prevent dirt penetrating the guidance system. The two extensions 18, 19 run parallel to one another and at right angles to one outer face 25 of casing 11. The two extensions 18, 19 are rigidly interconnected by a joint plate 26, the latter being screwed by means of screws 28 to spacers 27 fitted to the extensions.

On either side of the elongated slots 20, 21 outer face 25 has flat grooves, in which are laterally guided the sealing strips 23, 24, so that no lateral displacement of said strips is possible. This ensures a relatively smooth surface of outer face 25.

As can then more particularly be gathered from the simplified FIG. 2, auxiliary piston 16 acts against any attempt on the part of the arrangement to widen in the vicinity of the inner chamber 12 for piston 14. In addition, any lateral forces which can act on extension 18 are absorbed by the rigid arrangement of the two pistons and the joint plates 26, so that the lateral forces do not have to be absorbed by the longitudinal edges of elongated slots 20, 21.

FIG. 3 shows a modified embodiment of the auxiliary piston 39, which contains two cross-sectionally circular segmental portions 30, which cross-sectionally extend over somewhat less than half the circle and which are interconnected by a cylindrical central portion 31. Piston 39 fulfils the same functions as auxiliary piston 16 of FIG. 2, because it permits a guidance of the auxiliary piston on the inner wall of inner chamber 13. This piston has the further advantage that no air cushion can build up on either side thereof in the longitudinal direction. Obviously, the formation of the air cushion can be prevented by one or more bores or openings extending in the longitudinal direction of piston 16 in FIG. 2.

Figure 4:
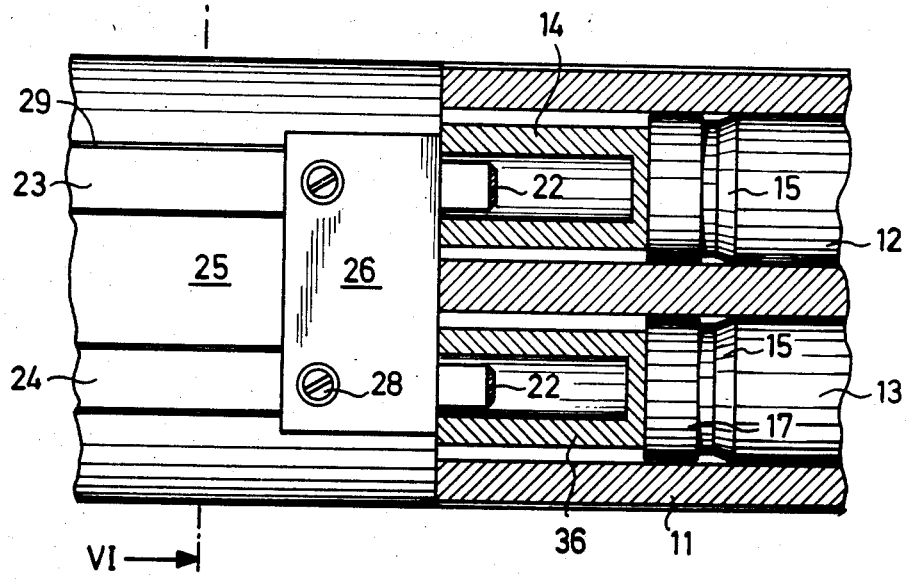
FIG. 4 is a view corresponding to FIG. 1 of another embodiment.
Figure 7:
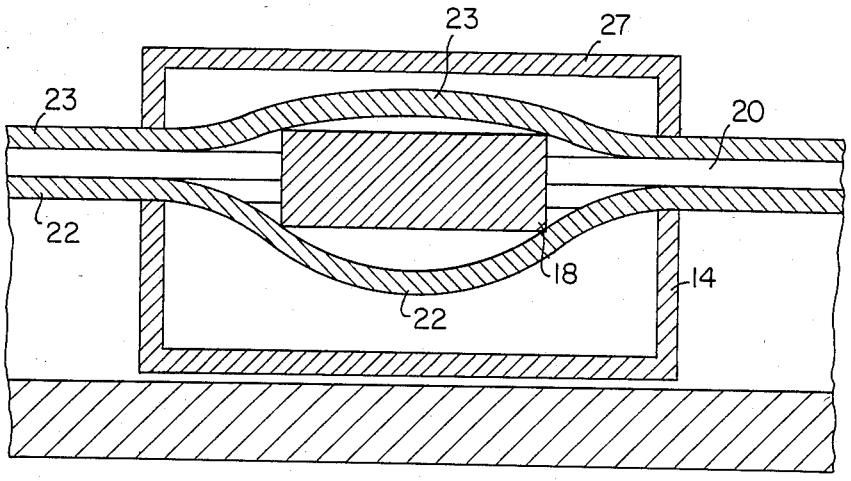
FIG. 7 is a longitudinal section along lines VII—VII in FIG. 3.

In the case of the embodiment of FIG. 4, the auxiliary piston 36 is once again constructed as a sealed piston, so that it has a packing 15 at either end. In this case, auxiliary piston 36 is also sealed from the inside of the casing by a sealing strip 22, which extends through the said piston. An arrangement showing sealing strips 22, 23 passing through the piston and force removal extension, respectively, is shown in FIG. 7. The construction of auxiliary piston 36 is the same as that of the force transmission piston 14 of FIG. 1. Otherwise, the embodiment according to FIG. 4 corresponds to that of FIG. 1, so that there is no need to describe it again. Due to the identical dimensions of the two casings, even in the case of an already existing cylinder, the auxiliary piston arrangement according to FIG. 1 can be replaced by an auxiliary piston arrangement according to FIG. 4.

FIG. 5 purely diagrammatically shows the end of a cylinder arrangement, as proposed by the invention. Casing 11 is frontally terminated by a component 40, which seals from the outside the two inner chambers 12, 13. Component 40 also contains the ends of the sealing strips. As can be gathered from FIG. 5, component 40 contains two connections for in each case one pressure line 42. Both pressure lines can be controlled separately of one another. This makes it possible for different pressure media to act on the two chambers and it must naturally also be possible to control them differently. It is obviously also possible to allow the same pressure medium to act in both inner chambers 12, 13 and this can once again be differently controlled.

It is naturally also possible for the same pressure medium to act under the same conditions in both pressure chambers.

The cross-section through casing 11 shown in FIG. 6 once again reveals the two parallel inner chambers, each of which contains a piston 14, 36. Both inner chambers, whose cross-section is filled by the piston and/or their packings 15, are displaced in the direction of the outside 25 relative to a median longitudinal plane of casing 11, so that the latter is asymmetrical with respect to said plane, which is indicated by the broken line 44 in FIG. 6. The force removal extensions 18, 19 of both pistons 14, 36 extend from the pistons in the direction of the outside 25 having a limited spacing with respect to the inner chambers.

Both inner chambers are separated from one another by a rigid partition 45, which extends transversely through casing 11. Outside 25, which bounds partition 45 towards the top, is constructed in a linear manner in the cross-section of FIG. 6, so that the two edges 46, 47 of the two elongated slots 20, 21 are located on either side of a strong web.

If pressure is e.g. introduced into the righthand inner chamber of FIG. 6, due to the elasticity of the material of casing 11, there is a slight enlargement of the inner chamber. Due to the fact that the inner chamber is positioned closer to the outer face 25 of casing 11 at which issue the force removal extensions 18, 19 and due to the rigid partition 45, the widening of the right-hand inner chamber only takes place on the right-hand edge region 48 of casing 11. The left-hand half of the right-hand inner chamber 13 remains circular without any deformation, whilst the right-hand half of the inner chamber 13 is enlarged towards the outside. Piston 36, which in the embodiment of FIG. 6 is identical to piston 14, is consequently guided in the same way on the left-hand half of inner chamber 13 as if the latter was not deformed. However, it is not possible for there to be any displacement of piston 36 to the right into the slightly widened part of inner chamber 13, because as a result of the rigid connection of piston 36 via extension 19, connecting bridge 26 and extension 18 with piston 14, the latter would have to be simultaneously moved to the right, which is prevented by partition 45. Thus, piston 36 as well as piston 14, remains in its normal position in the case of widening of the two inner chambers, which leads to the desired precise guidance.

The same naturally occurs when starting with the left-hand piston 14, on considering the arrangement according to FIG. 6. Thus, piston 36 is constructed in exactly the same way as piston 14 and also has an inner sealing strip 49 corresponding to the inner sealing strip 22 of piston 14. The outer sealing strips 23, 24 are also identical in the case of both pistons.

Both force removal extensions 18, 19 run parallel to one another and pass out on the same outer face 25 of casing 11. The distance between the inner wall of the two inner chambers 12, 13 and the outer face 25 at which the force removal extensions 18, 19 issue, is much smaller than the corresponding distance on the opposite outside 50 of casing 11.

What is claimed is:

1. A pressure cylinder comprising:

a casing having walls defining two side-by-side parallel tubes having longitudinal slots extending radially of the tubes through the casing, the slots both being disposed on a same side of the casing, the slots separating the casing into an inner partition and two outer walls;

two pistons disposed in the casing, the pistons being slidable in the tubes, the pistons having packings sealingly slidable to seal the pistons with respect to the tubes and the slots;

two force removal extensions attached to the pistons and extending radially of the pistons through the slots, the force removal extensions being parallel to one another;

a joint plate rigidly attached to the force removal extensions, the joint plate and the force removal extensions rigidly holding the pistons on opposite sides of the inner partition such that the pistons are aligned to slide along the inner partition; and, means for supplying a pressure medium to the tubes to drive the pistons in the tubes;

whereby deformation of the casing upon supplying the pressure medium to the tubes cannot disturb alignment of the pistons around the inner partition.

2. An improved pressure cylinder of the type having a casing with walls defining tubular chambers, the chambers having movable pistons therein, the casing having longitudinal slots along the chambers and the pistons each having a force removal extension extending laterally through an associated one of the slots, the casing having inlets and outlets to the chambers, the cylinders being sealed along the slots by sealing strips extending through at least one of the force removal extensions and the pistons, the cylinder comprising:

the chambers in the casing being two parallel cylindrical chambers, the longitudinal slots for both the two chambers extending along a same side of the casing, such that the two chambers are separated by a central partition of the casing between two chambers;

the force removal extension for each of the pistons projecting outwards from said piston through the associated slot, the force removal extensions of the pistons being parallel; and, a connecting device including a joint plate attaching together the force removal extensions of each piston, the pistons, force removal extensions and connecting device together closing partly around the central partition, whereby the pistons are guided along the central partition regardless of displacement of the casing walls.

3. A pressure cylinder according to claim 2, wherein the inner chambers are constructed for the action of the same pressure medium.

4. A pressure cylinder according to claim 2, wherein the inner chambers are constructed for the action of different pressure media.

5. A pressure cylinder according to claim 2, wherein both pistons have approximately the same length and the joint plate extends roughly over the entire length of the pistons.

6. A pressure cylinder according to claim 2, wherein both pistons have an identical construction.

7. A pressure cylinder according to claim 1, wherein in the vicinity of the elongated slots, the casing has a device cooperating with the sealing strip for the positive fixing thereof.

* * * * *

UNITED STATES PATENT AND TRADEMARK OFFICE

CERTIFICATE OF CORRECTION

PATENT NO. : 4,601,234

DATED : July 22, 1986

INVENTOR(S) : Rainer E. Hoinkis

It is certified that error appears in the above-identified patent and that said Letters Patent is hereby corrected as shown below:

Column 1, line 15, after "chamber" insert --has--.

Column 1, line 25, delete "extension" and insert --extensions--.

Column 2, line 19, before "common" insert --a--.

Column 5, line 23, after "two" insert --inner--.

Signed and Sealed this

First Day of December, 1987

*Attest:*

DONALD J. QUIGG

*Attesting Officer*

*Commissioner of Patents and Trademarks*